US008155963B2

(12) United States Patent
Aaron et al.

(10) Patent No.: US 8,155,963 B2
(45) Date of Patent: Apr. 10, 2012

(54) AUTONOMOUS SYSTEM AND METHOD FOR CREATING READABLE SCRIPTS FOR CONCATENATIVE TEXT-TO-SPEECH SYNTHESIS (TTS) CORPORA

(75) Inventors: Andrew Stephen Aaron, Ardsley, NY (US); David Angelo Ferrucci, Yorktown Heights, NY (US); John Ferdinand Pitrelli, Danbury, CT (US)

(73) Assignee: Nuance Communications, Inc., Burlington, MA (US)

( * ) Notice: Subject to any disclaimer, the term of this patent is extended or adjusted under 35 U.S.C. 154(b) by 1131 days.

(21) Appl. No.: 11/332,292

(22) Filed: Jan. 17, 2006

(65) Prior Publication Data

US 2007/0168193 A1 Jul. 19, 2007

(51) Int. Cl.
*G10L 13/06* (2006.01)

(52) U.S. Cl. ..... 704/260; 704/258; 704/267

(58) Field of Classification Search ..... 704/260
See application file for complete search history.

(56) References Cited

U.S. PATENT DOCUMENTS

| | | | | |
|---|---|---|---|---|
| 5,737,725 | A * | 4/1998 | Case | 704/260 |
| 5,758,323 | A * | 5/1998 | Case | 704/278 |
| 6,144,938 | A * | 11/2000 | Surace et al. | 704/257 |
| 6,173,263 | B1 * | 1/2001 | Conkie | 704/260 |
| 6,539,354 | B1 * | 3/2003 | Sutton et al. | 704/260 |
| 6,990,449 | B2 * | 1/2006 | Case | 704/260 |
| 6,990,451 | B2 * | 1/2006 | Case et al. | 704/260 |
| 7,174,295 | B1 * | 2/2007 | Kivimaki | 704/260 |
| 7,308,407 | B2 * | 12/2007 | Reich | 704/266 |
| 7,328,157 | B1 * | 2/2008 | Chu et al. | 704/260 |
| 7,693,719 | B2 * | 4/2010 | Chu et al. | 704/270.1 |
| 2002/0010584 | A1 * | 1/2002 | Schultz et al. | 704/270 |
| 2003/0028380 | A1 * | 2/2003 | Freeland et al. | 704/260 |
| 2003/0158734 | A1 * | 8/2003 | Cruickshank | 704/260 |
| 2005/0108013 | A1 * | 5/2005 | Karns | 704/254 |

OTHER PUBLICATIONS

Haiping et al, "Generating Script Using Statistical Information of The Context Variation Unit Vector" Sep. 2002, ISCA Archive, ICSLP2002, pp. 1-4.*

Eide et al "A Corpus-Based Approach to Expressive speech Synthesis" Jun. 2004, Fifth ISCA ITRW on Speech Stnthesis, pp. 79-84.*

Hamza et al "Data-Driven Segment Preselection in the IBM Trainable Speech Synthesis System", Sep. 2002, ISCA Archive, ICSLP2002, pp. 1-4.*

Zhu et al "Corpus Building For Data-Driven TTS Systems", Sep. 2002, Proceedings of the 2002 IEEE Workshop on speech synthesis, pp. 199-202.*

* cited by examiner

*Primary Examiner* — Richemond Dorvil
*Assistant Examiner* — Olujimi Adesanya
(74) *Attorney, Agent, or Firm* — Wolf, Greenfield & Sacks, P.C.

(57) ABSTRACT

A method (and system) which autonomously generates a cohesive script from a text database for creating a speech corpus for concatenative text-to-speech, and more particularly, which generates cohesive scripts having fluency and natural prosody that can be used to generate compact text-to-speech recordings that cover a plurality of phonetic events.

21 Claims, 4 Drawing Sheets

AUTONOMOUS SYSTEM AND METHOD FOR CREATING READABLE SCRIPTS FOR CONCATENATIVE TEXT-TO-SPEECH SYNTHESIS (TTS) CORPORA

BACKGROUND OF THE INVENTION

1. Field of the Invention

The present invention generally relates to a method and system for providing an improved ability to create a cohesive script for generating a speech corpus (e.g., voice database) for concatenative Text-To-Speech synthesis ("concatenative TTS"), and more particularly, for providing improved quality of that speech corpus resulting from greater fluency and more-natural prosody in the recordings based on the cohesive script.

For purposes of this disclosure, "phoneme" means the smallest unit of speech used in linguistic analysis. For example, the sound represented by "s" is a phoneme. However, for generality, where "phoneme" appears below it can refer to shorter units, such as fractions of a phoneme e.g. "burst portion of t" or "first ⅓ of s", or longer units, such as syllables.

Also, the sounds represented by "sh" or "k" are examples of phonemes which have unambiguous pronunciations. It is noted that phonemes (e.g., "sh") are not equivalent to the number of letters. That is, two letters (e.g., "sh") can make one phoneme, and one letter, "x", can make two phonemes, "k" and "s".

As another example, English speakers generally have a repertoire of about 40 phonemes and utter about 10 phonemes per second. However, the ordinarily skilled artisan would understand that the present invention is not limited to any particular language (e.g., English) or number of phonemes (e.g., 40). The exemplary features described herein with reference to the English language are for exemplary purposes only.

For purposes of this disclosure, "concatenative" means joining together sequences of recordings of phonemes. "Phonemes" include linguistic units, e.g. there is one phoneme "k". However, a concatenative system will employ many recordings of "k", such as one from the beginning of "kook" and another from "keep", which sound considerably different.

Also, for purposes of this disclosure, a "text database" means any collection of text, for example, a collection of existing sentences, phrases, words, etc., or combinations thereof. A "script" generally means a written text document, or collection of words, sentences, etc., which can be read by a professional speaker to generate a speech database, or a speech corpus (or corpora). A "speech corpus" (or "speech corpora") generally means a collection of speech recordings or audio recordings (e.g., which are generated by reading a script).

2. Description of the Conventional Art

Conventional systems have been developed to perform concatenative TTS. Generally, in conventional methods and systems, the first step in creating a speech corpus for concatenative TTS software is recording a professional speaker reading a very large "script". Such scripts typically can include about 10,000 sentences. Thus, this first step can take two to three weeks to complete.

The conventional script generally is made up largely of words and phrases that are chosen for their diverse phoneme content, to ensure ample representation of most or all of the English phoneme sequences.

A conventional method of generating the script (i.e., gathering these phonemically-rich sentences), is by data mining. For purposes of this disclosure, "data mining" generally includes, for example, searching through a very large text database to find words or word sequences containing the required phoneme sequences.

The conventional methods, however, have several drawbacks or disadvantages. For example:

1) A database sufficiently large to deliver the required phonemic content generally may contain many sentences with grammatical errors, poor writing, non-English words, and other impediments to smooth oral delivery by the speaker.

2) The conventional systems and methods generally are extremely inefficient.

For example, a rare phoneme sequence may be found embedded in a 20-word sentence. Thus, incorporating this 20-word sentence into the script provides one useful word but also drags 19 superfluous words along with it. Thus, the length of the script is undesirably increased. Omitting the superfluous words would preclude smooth reading of sentences.

Scripts that are generated by conventional methods and systems contain numerous examples of this problem. That is, a script is generated by conventional means to include a long difficult sentence solely for the purpose of providing one essential word (or phrase, etc.).

3) In conventional methods and systems, because sentences are chosen independently of each other, it follows that they can be (and generally are) very dissimilar in subject matter, writing quality, word count, sentence structure, etc. Such dissimilarities provide the speaker with a very difficult reading task.

For example, rather than one sentence flowing sensibly into another, as ordinary prose generally does, a script developed according to the conventional methods and systems can read more like a hodgepodge of often awkward sentences that are stripped of their original context. Thus, professional speakers who are called upon to read these conventional scripts, for example, for three hours or more in a single stretch of time, usually consider the task to be an onerous one, which can affect the quality of the reading.

4) In conventional methods and systems, it generally is difficult to read the script generated by conventional methods and systems very well.

For example, there generally is no overarching or overall meaning, so it can be difficult for the speaker to know what to emphasize or how to give natural prosody to the script. Such dissimilar material lends itself to inconsistent reading style, which creates inconsistencies in the corpus (e.g., speech corpus generated by reading the script) which harms TTS quality.

Also, since the speaker's reading prosody will be analyzed and ultimately incorporated into the product, this lack of natural reading prosody has a deleterious effect on the final TTS output.

Applicants have recognized that, as the focus of advancement of TTS technology progresses from segmental quality to prosody and expression, such awkward material generated by the conventional methods and systems becomes a greater and greater hindrance to the improvement of the art.

The conventional methods and systems have not addressed or provided any acceptable solutions to this problem other than, for example, merely minimizing the problem (instead of solving the problem) using stopgap measures such as editing the script by hand. Applicant has recognized that such conventional methods and systems, for example, using stopgap measures, increasingly are impractical because computer memory and computation power continually enable datasets to expand.

5) Moreover, Applicants have recognized that, even if the speaker were to overcome the onerous-reading problem, the conventional hodgepodge of often awkward sentences also makes it difficult to gather a speech corpus which provides examples of the prosody unique to longer coherent passages, such as paragraph-level phenomena, de-accenting of repeated words as a function of how recently they had appeared, etc.

While a search could be made to gather paragraphs instead of sentences, the problem of incorporating a paragraph (or paragraphs) into the script to provide one example of paragraph-level phenomena would drag superfluous words and/or sentences along with it. Thus, the length of the script undesirably would be increased, thereby exacerbating the problem described above, which respect to dragging superfluous words into the script.

Practically, one approach used to address this problem is to have separate text database sections—one focused on phonemic coverage, and another on longer-passage fluency. However, this approach is undesirable, for example, because it is inefficient, in that neither of the separate text database sections contributes to the measured coverage of the other.

SUMMARY OF THE INVENTION

In view of the foregoing and other exemplary problems, drawbacks, and disadvantages of the conventional methods and structures, an exemplary feature of the present invention is to provide a method and system for providing an improved ability to create a script, and the speech corpus (i.e., a voice or speech database) for concatenative Text-To-Speech generated by reading such a script. The present invention more particularly provides improved quality of the speech corpus resulting from greater fluency and more-natural prosody in the recordings.

In the exemplary case of the English language, the present invention exemplarily begins with the assumption that it generally would be desirable (e.g., necessary) for a speaker to read about 10,000 English phoneme sequences. However, Applicants have recognized that those sounds preferably can be embedded in real sentences which have some meaning.

For example, a list of sounds (e.g., "oot," "ool," "oop," etc) can be provided. However, it can be difficult to easily make sentences that assimilate such a list of sounds.

The present invention, however, preferably can consult a pronunciation dictionary and find a list of words, or in some cases word sequences (e.g., pairs), that contain the desired (e.g., required) sounds. Thus, a list of 10,000 words or word sequences could be provided. However, a fluently-readable script still may not be produced.

Thus, to solve the aforementioned problems which have been recognized by Applicants, an intelligent software system preferably can be provided that can take as its input an unstructured vocabulary list and autonomously produce one or more cohesive written text documents (i.e., cohesive scripts), which can be read by a professional speaker to generate a speech corpus (or corpora) having greater fluency and more-natural prosody in the recordings.

For example, a series of pre-written templates preferably can imbue the document with ideas, concepts, and characters that can be used to form the basis of its storyline or content.

The exemplary features of the invention preferably can include script structural templates which can be thought of as grammars for generating different types of scripts that satisfy predetermined structural properties. The script structural templates may cascade, for example, into paragraph and sentence templates.

The exemplary invention preferably can include templates to produce conceptual coherence such as a story line, plot, or theme for selecting characters and events to describe, and the order in which they will be introduced. These templates preferably can be used to populate the script with content.

The exemplary invention preferably provides a script that can meet many (or all) of the requirements of conventional scripts by containing many (or all) of the required phoneme sequences in a far more efficient way by providing a scripts which may contain a higher concentration of required phoneme sequences in each sentence.

Furthermore, a script provided according to the exemplary invention preferably may be much easier to read than a script provided according to the conventional methods and systems.

The exemplary aspects of the present invention can improve the recording process by making the recording process faster and cheaper; and also can improve the resulting speech corpus, for example, because the script may be read with a more natural inflection.

For example, in a first exemplary aspect of the invention, a method of generating a speech corpus for concatenative text-to-speech includes autonomously generating a cohesive script from a text database. The method preferably includes selecting a word or a word sequence from the text database based on an enumerated phoneme sequence, and then generating a coherent script including the selected word or word sequence. The enumerated phoneme sequence preferably includes a diphone, a triphone, a quadphone, a syllable, and/or a bisyllable.

In one exemplary aspect of the invention, the method preferably includes extracting at least one predetermined sequence of phonemes from the text database, associating the predetermined sequence of phonemes with a plurality of words included in the text database that include the predetermined sequence of phonemes, selecting N words that include the predetermined sequence of phonemes, and generating the cohesive script based on the N words.

The text database preferably includes an unstructured vocabulary list, an inventory of occurrences of at least one phonemic unit, an inventory of occurrences of at least one phonemic sequence, a dictionary, and/or a word pronunciation guide.

Particularly, the autonomous generation of the cohesive script preferably includes extracting a plurality of triphones from the text database, associating each of the plurality of triphones with a plurality of words included in the text database that include the each of the plurality of triphones, selecting N words that include each of the plurality of triphones, and generating the cohesive script based on the N words.

In another exemplary aspect of the invention, a system for generating a speech corpus for concatenative text-to-speech includes an extracting unit that extracts a plurality of triphones from a text database, an associating unit that associates each of the plurality of triphones with a plurality of words included in the text database that include the each of the plurality of triphones, a selecting unit that selects N words that include each of the plurality of triphones, and an input unit that inputs the N selected words into an autonomous language generating unit, wherein the autonomous language generating unit generates the cohesive script.

BRIEF DESCRIPTION OF THE DRAWINGS

The foregoing and other exemplary purposes, aspects and advantages will be better understood from the following detailed description of an exemplary embodiment of the invention with reference to the drawings, in which.

DETAILED DESCRIPTION OF EXEMPLARY ASPECTS OF THE INVENTION

Figure 1:
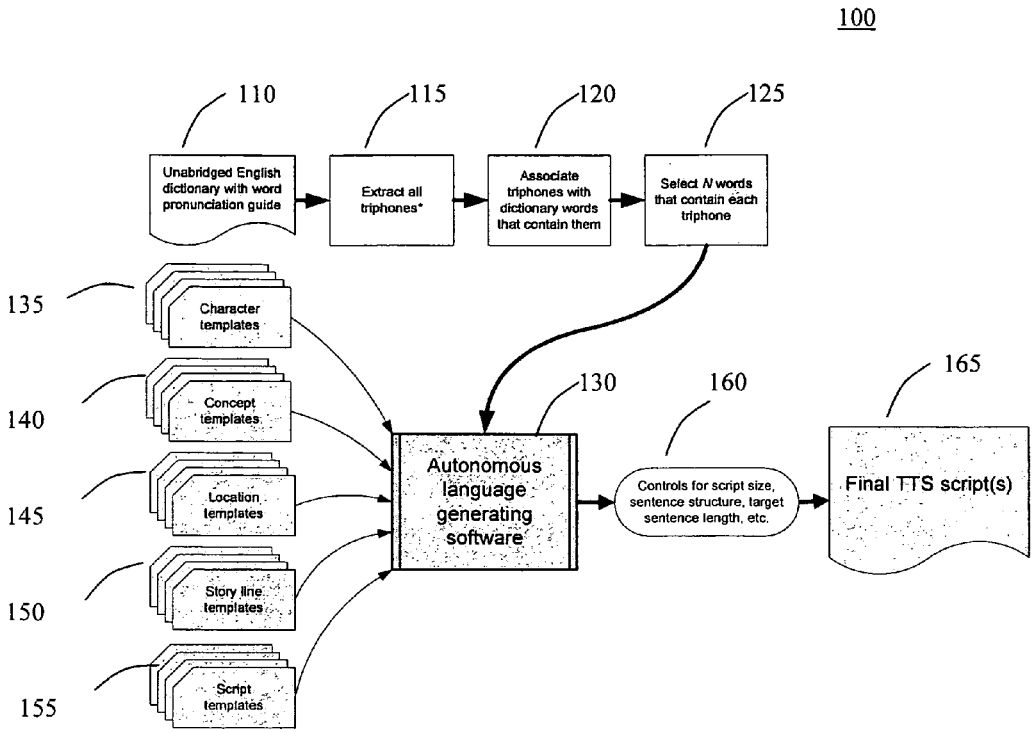
FIG. 1 illustrates an exemplary system 100 according to the present invention.

Referring now to the drawings, and more particularly to FIGS. 1-5, there are shown exemplary aspects of the method and structures according to the present invention.

The unique and unobvious features of the exemplary aspects of the present invention are directed to a novel system and method for providing an improved ability to create a voice database for concatenative Text-To-Speech. More particularly, the exemplary aspects of the invention provide improved quality of that database resulting from greater fluency and more-natural prosody in the script used to make the recordings, as well as more compactness of coverage of a plurality of phonetic events.

Referring to the features exemplarily illustrated in the system 100 of FIG. 1, the exemplary invention preferably provides an extracting unit that extracts (e.g., see 115), for example, all triphones from an unabridged English dictionary including a word pronunciation guide (e.g., see 110).

For purposes of this disclosure, the term "triphone" generally means, for example, any phonetic sequence, which might include a diphone, etc. For example, a "triphone" can be a sequence of (or phrase having) three phonemes. The ordinarily skilled artisan would understand, however, that the present invention is not limited to triphones, and also may include diphones, quadphones, syllables, bisyllables, etc.

For purposes of this disclosure, the term "diphone" generally means, for example, a unit of speech that includes the second half of one phoneme followed by the first half of the next phoneme, cut out of the words in which they were originally articulated. In this way, diphones contain the transitions from one sound to the next. Thus, diphones form building blocks for synthetic speech.

For example, the phrase "picked carrots" includes a triphone (e.g., the phonetic sequence of phonemes k-t-k). Thus, this triphone, or phonetic sequence of phonemes, could be included in a sentence or phrase in the script. According to the present invention, most, or preferably, all of the possible triphones may be included in the script. The triphones can be bordered by the middle of the phone or syllable (as typically done for diphones) or bordered by the edge.

As mentioned above, the ordinarily skilled artisan would understand that the present invention is not limited to triphones, and also may include diphones, quadphones, syllables, bisyllables, etc.

The ordinarily skilled artisan would understand, however, that the present invention is not limited to triphones, and also may include diphones, quadphones, etc.

Next, according to the present invention, the triphones preferably can be associated with dictionary words that contain such triphones (e.g., see 120). The exemplary invention preferably selects N words that contain each triphone (e.g., see 125).

The N selected words are then input into an autonomous language generating unit e.g., 130; which performs the steps according to an autonomous language generating software).

The autonomous language generating unit (e.g., 130) preferably receives an input from a character template unit including one or more character templates (e.g., 135), a concept template unit including one or more concept templates (e.g., 140), a location template unit including one or more location templates (e.g., 145), a story line template unit including one or more story line templates (e.g., 150), a script template unit including one or more script templates (e.g., 155), etc.

The exemplary invention also preferably includes a control unit (e.g., 120) that controls format mechanics (e.g., script size, sentence structure, target sentence length, etc.) of the autonomous language generated by the autonomous language generating unit (e.g., 130).

The resulting data output from the autonomous language generating unit (e.g., 130) and the control unit (e.g., 160) provides a TTS script (or script) (e.g., 165), which solves the aforementioned problems of the conventional methods and systems.

As discussed above, in the exemplary case of the English language, the present invention exemplarily begins with the assumption that it generally would be desirable (e.g., necessary) for a speaker to read about 10,000 English phoneme sequences. However, Applicants have recognized that those sounds preferably can be embedded in real sentences which have some meaning.

For example, a list of sounds (e.g., "oot," "ool," "oop," etc) can be provided. However, it can be difficult to easily make sentences that assimilate such a list of sounds.

The present invention, however, preferably can consult a pronunciation dictionary and find a list of words, or in some cases word sequences, that contain the preferred or required sounds. Thus, a list of 10,000 words or word sequences could be provided. However, a fluently-readable script still may not be produced.

Thus, to solve the aforementioned problems which have been recognized by Applicants, an intelligent software system preferably can be provided that can take as its input a text database, including, for example, an unstructured vocabulary list, and autonomously produce one or more cohesive written text documents (i.e., cohesive scripts).

For example, a series of pre-written templates preferably can imbue the cohesive script with ideas, concepts, and characters that can be used to form the basis of the storyline or content of the cohesive script.

The exemplary features of the invention preferably can include script structural templates which can be considered to be grammars for generating different types of scripts that satisfy predetermined structural properties. The script structural templates may cascade, for example, into paragraph and sentence templates.

The exemplary invention preferably can include templates to produce conceptual coherence such as a story line, plot, or theme for selecting characters and events to describe, and the order in which they will be introduced. These templates preferably can be used to populate the cohesive script with content.

A cohesive script provided according to the exemplary invention preferably would meet many (or all) of the requirements of conventional scripts (i.e., it would contain many (or all) of the required phoneme sequences) in a far more efficient way because the present invention would contain a higher concentration of required phoneme sequences in each sentence. Thus, the cohesive script, and the resulting speech corpus, preferably would be shorter as compared to the conventional systems and methods.

Also, the time to read such a cohesive script, and therefore, the time to generate the speech corpus, preferably would be reduced as compared to the conventional systems and methods.

Furthermore, a cohesive script provided according to the exemplary invention preferably would be much easier to read than a script provided according to the conventional methods and systems.

The above exemplary advantages of the present invention would make the recording process faster and cheaper, while also improving the resulting speech corpus, for example, because the script could be read with a more natural inflection.

Figure 2:
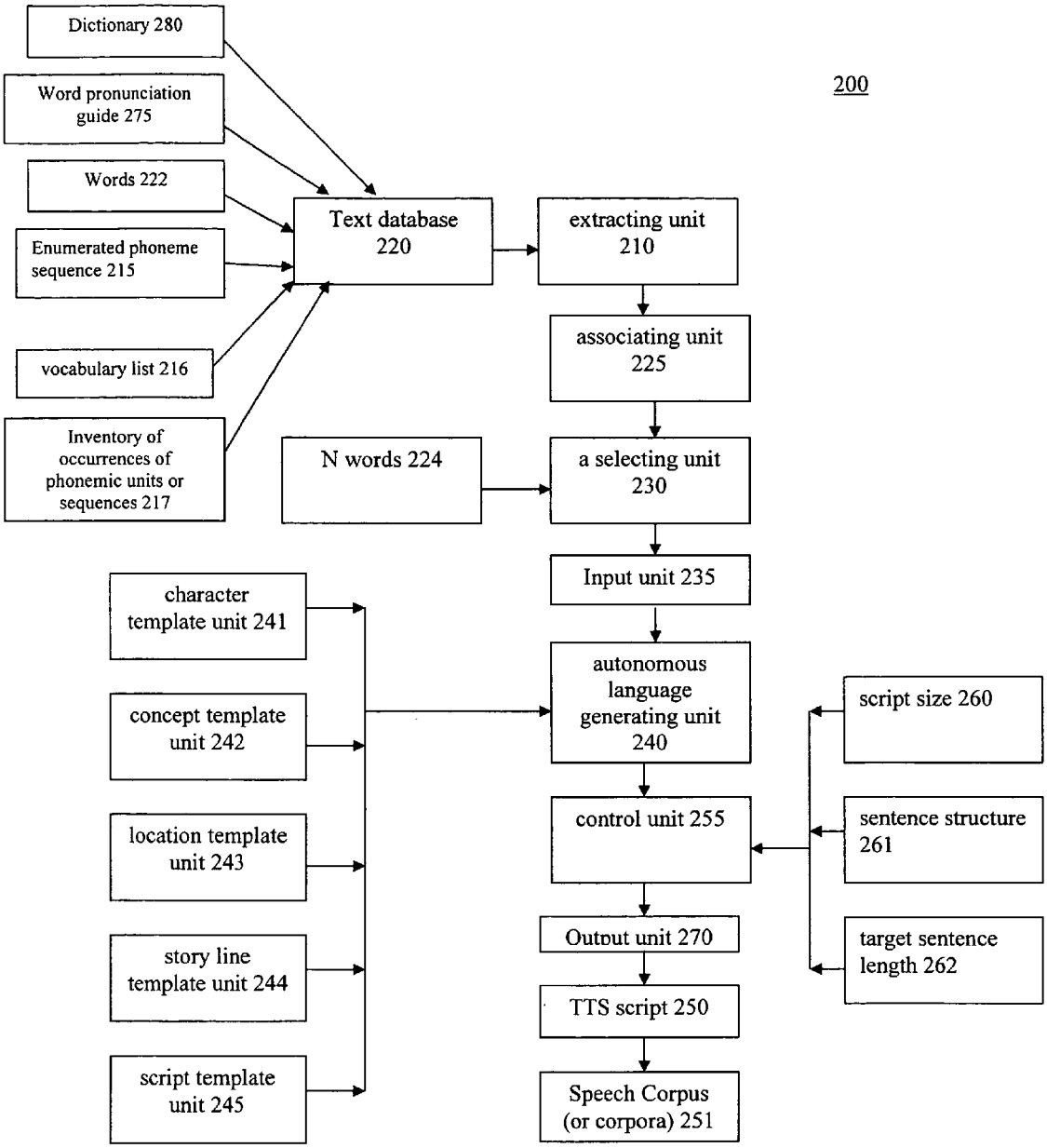
FIG. 2 illustrates another exemplary system 200 according to the present invention.

Turning to FIG. 2, an exemplary system for generating a speech corpus for concatenative text-to-speech, preferably includes an extracting unit (e.g., 210) that extracts an enumerated phoneme sequence (e.g., a triphone, diphone, quadphone, syllable, bisyllable, etc., or a plurality thereof; e.g., 215) from a text database (e.g., 220). As mentioned above, the ordinarily skilled artisan would understand, however, that the present invention is not limited to triphones, and also may include diphones, quadphones, etc.

The text database preferably may include one or more dictionary databases (e.g., 280), word pronunciation guide databases (e.g., 275), word databases (e.g., 220), enumerated phoneme sequence database (e.g., a triphone, diphone, quadphone, syllable, and/or bisyllable database, etc., or a plurality thereof; e.g., 215), vocabulary lists or databases (e.g., 216), inventory of occurrences of phonemic units or sequences (e.g., 217), etc.

The system preferably may include an associating unit (e.g., 225) that associates each of the enumerated phoneme sequences (e.g., a triphone, diphone, quadphone, syllable, bisyllable, etc., or a plurality thereof; e.g., 215) with a plurality of words (e.g., 222) included in the text database (e.g., 220) that include each of the enumerated phoneme sequences (e.g., a triphone, diphone, quadphone, syllable, bisyllable, etc., or a plurality thereof; e.g., 215). The system preferably can include a selecting unit (e.g., 230) that selects N words (e.g., 224) that include each of the enumerated phoneme sequences, as well as an input unit (e.g., 235) that inputs the N selected words (e.g., 224) into an autonomous language generating unit (e.g., 240), which generates a cohesive script (e.g., 250). The cohesive script may be read by a user (e.g., a professional speaker) to generate a speech corpus (or corpora)(e.g., 251) for concatenative TTS.

The autonomous language generating unit preferably receives input from at least one of a character template unit (e.g., 241), a concept template unit (e.g., 242), a location template unit (e.g., 243), a story line template unit (e.g., 244), and a script template unit (e.g., 245).

The system preferably includes a control unit (e.g., 255) that controls format mechanics (e.g., at least one of a script size (e.g., 260), a sentence structure (e.g., 261), a target sentence length (e.g., 262), etc.) of the autonomous language generated by the autonomous language generating unit.

The system preferably includes an output unit (e.g., 270) that outputs the script (e.g., 250), which can be used to generate an improved speech corpus (e.g., 251) for concatenative TTS.

Figure 3:
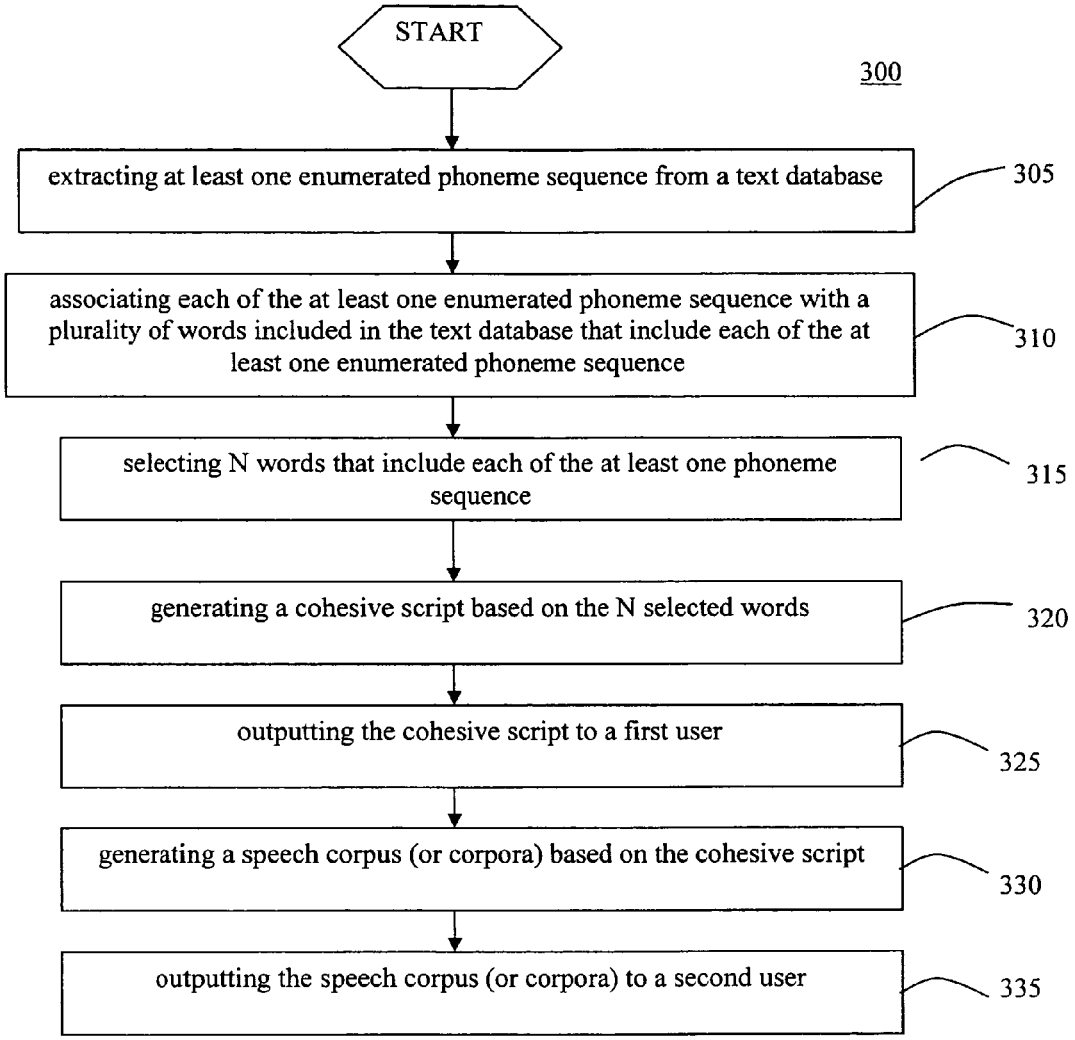
FIG. 3 illustrates an exemplary method 300, according to the present invention.

Turning to FIG. 3, an exemplary method 300 of generating a speech corpus for concatenative text-to-speech, preferably includes extracting a plurality of triphones from a text database (e.g., see step 305), associating each of the enumerated phoneme sequences (e.g., a triphone, diphone, quadphone, syllable, bisyllable, etc., or a plurality thereof; e.g., 215) with a plurality of words included in the text database that include the each of the enumerated phoneme sequences (e.g., see step 310), selecting N words that include each of the enumerated phoneme sequences (e.g., see step 315), generating a cohesive script based on the N selected words (e.g., see step 320), outputting the cohesive script to a first user (e.g., a user/person who reads the cohesive script; e.g., see step 325), generating a speech corpus (e.g., see step 330), and outputting an improved speech corpus to a second user (e.g., a user/person who uses the corpus for synthesis; e.g., see step 335).

The cohesive script (and thus, the resulting speech corpus) preferably is generated based on at least one of a character template, a concept template, a location template, a story line template, and a script template. The method also preferably controls format mechanics (e.g., at least one of a script size, a sentence structure, a target sentence length of the script, etc.), and thus, the resulting speech corpus.

The resulting script can then be output (e.g., see step 325) to a user (e.g., professional speaker) to generate an improved speech corpus according to the present invention (e.g., see steps 330, 335).

Another exemplary aspect of the invention is directed to a method of deploying computing infrastructure in which computer-readable code is integrated into a computing system, and combines with the computing system to perform the method described above.

Yet another exemplary aspect of the invention is directed to a signal-bearing medium tangibly embodying a program of machine-readable instructions executable by a digital processing apparatus to perform the exemplary method described above.

Figures 4, 5:
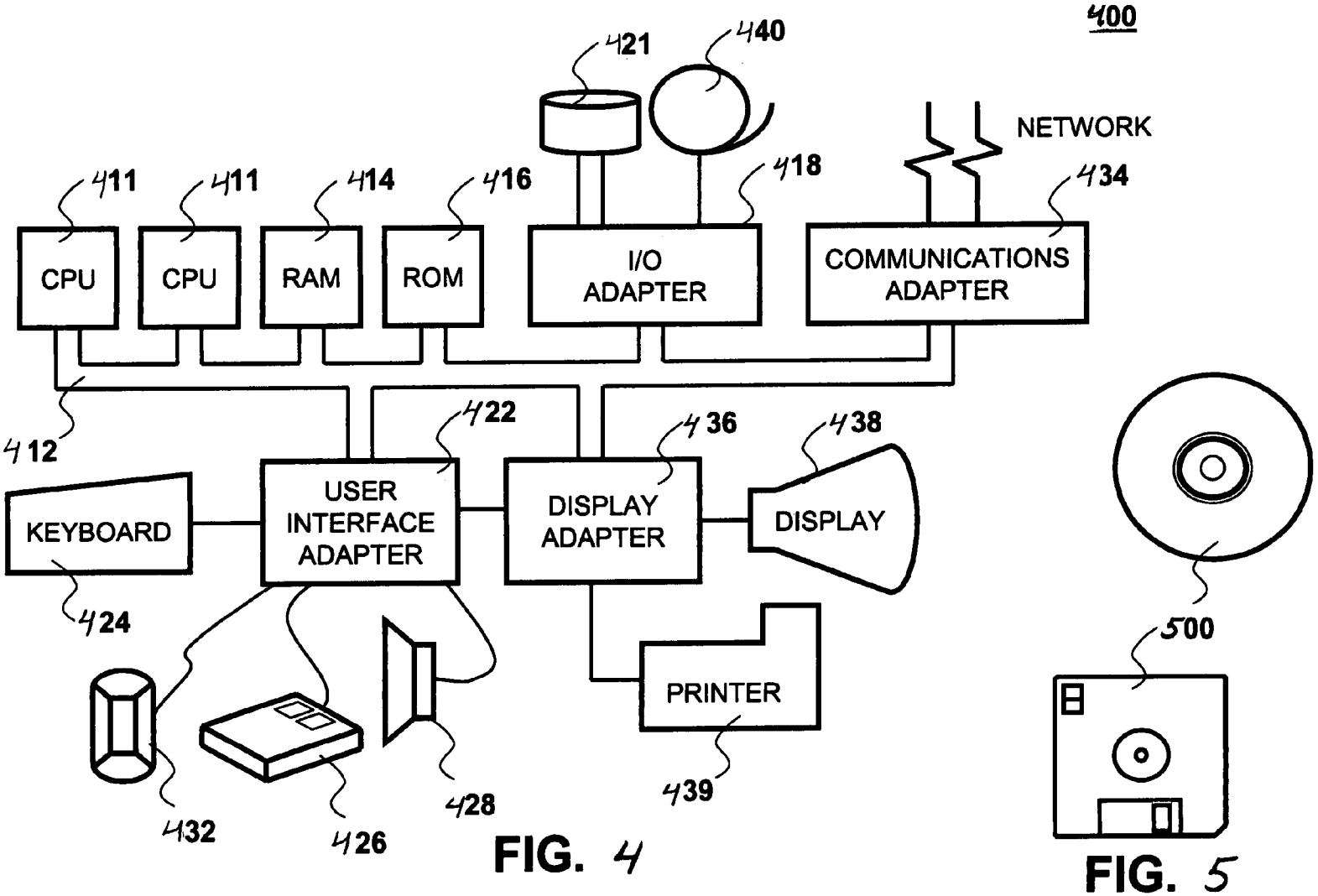
FIG. 4 illustrates an exemplary hardware/information handling system 400 for incorporating the present invention therein.
FIG. 5 illustrates a recordable signal bearing medium 500 (e.g., recordable storage medium) for storing steps of a program of a method according to the present invention.

FIG. 4 illustrates a typical hardware configuration of an information handling/computer system for use with the invention and which preferably has at least one processor or central processing unit (CPU) 411.

The CPUs 411 are interconnected via a system bus 412 to a random access memory (RAM) 414, read-only memory (ROM) 416, input/output (I/O) adapter 418 (for connecting peripheral devices such as disk units 421 and tape drives 440 to the bus 412), user interface adapter 422 (for connecting a keyboard 424, mouse 426, speaker 428, microphone 432, and/or other user interface device to the bus 412), a communication adapter 434 for connecting an information handling system to a data processing network, the Internet, an Intranet, a personal area network (PAN), etc., and a display adapter 436 for connecting the bus 412 to a display device 438 and/or printer.

In addition to the hardware/software environment described above, a different aspect of the invention includes a computer-implemented method for performing the above method. As an example, this method may be implemented in the particular environment discussed above.

Such a method may be implemented, for example, by operating a computer, as embodied by a digital data processing apparatus, to execute a sequence of machine-readable instructions. These instructions may reside in various types of signal-bearing media.

This signal-bearing media may include, for example, a RAM contained within the CPU 411, as represented by the fast-access storage for example. Alternatively, the instructions may be contained in another signal-bearing media, such as a magnetic data storage or CD-ROM diskette 500 (FIG. 5), directly or indirectly accessible by the CPU 411.

Whether contained in the diskette 500, the computer/CPU 411, or elsewhere, the instructions may be stored on a variety of machine-readable data storage media, such as DASD storage (e.g., a conventional "hard drive" or a RAID array, magnetic tape, electronic read-only memory (e.g., ROM, EPROM, or EEPROM), an optical storage device (e.g. CD-ROM, WORM, DVD, digital optical tape, etc.), paper "punch" cards, or other suitable signal-bearing media including transmission media such as digital and analog and communication links and wireless.

In an illustrative embodiment of the invention, the machine-readable instructions may comprise software object code, compiled from a language such as "C", etc.

Additionally, in yet another aspect of the present invention, it should be readily recognized by one of ordinary skill in the art, after taking the present discussion as a whole, that the present invention can serve as a basis for a number of business or service activities. All of the potential service-related activities are intended as being covered by the present invention.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. A method of generating a script to be read by a speaker to produce a speech corpus for concatenative text-to-speech using a text database storing at least a dictionary of words and a pronunciation guide indicating pronunciations of at least some of the words in the dictionary, the method comprising:

obtaining a list of phonemes to be uttered when the script is read by a speaker;

automatically selecting a first plurality of words from the dictionary based on the pronunciation guide such that the plurality of words, when uttered by the speaker, produces at least the phonemes in the list of phonemes;

obtaining at least one template defining structural properties of at least one grammar; and generating a cohesive script based, at least in part, on the at least one template and the first plurality of words, wherein the cohesive script comprises multiple sentences, and wherein at least two of the multiple sentences have conceptual coherence when considered together.

2. The method according to claim 1, wherein the list of phonemes includes at least one phoneme sequence comprising a plurality of phonemes in a prescribed order, and wherein automatically selecting a first plurality of words comprises selecting at least one word that, when uttered by the speaker, produces the at least one phoneme sequence.

3. The method according to claim 2, wherein the at least one phoneme sequence comprises a diphone, a triphone, a quadphone, a syllable, and/or a bisyllable.

4. The method according to claim 1, wherein the list of phonemes includes a plurality of phoneme sequences and wherein obtaining the list of phonemes includes obtaining the list of phonemes, at least in part, by analyzing the text database.

5. The method according to claim 4, wherein the plurality of phoneme sequences comprise a plurality of diphones, a plurality of triphones, a plurality of quadphones, a plurality of syllables, and/or a plurality of bisyllables.

6. The method according to claim 1, wherein the text database comprises a vocabulary list, an unstructured vocabulary list, an inventory of occurrences of at least one phonemic unit, and/or an inventory of occurrences of at least one phonemic sequence.

7. The method according to claim 1, wherein the at least one template comprises a character template, a concept template, a location template, a story line template, and/or a script template that each include structural properties that assist in forming the cohesive script.

8. The method according to claim 4, further comprising generating the speech corpus by having the speaker utter the cohesive script.

9. The method according to claim 4, further comprising controlling format mechanics of the cohesive script.

10. The method according to claim 9, wherein said format mechanics comprise a script size, a sentence structure, and/or a target sentence length of the cohesive script.

11. The method of claim 1, wherein all of the sentences in the coherent script have conceptual coherence.

12. At least one non-transitory machine-readable storage medium encoded with machine-readable instructions that, when executed by at least one processor, perform a method of generating a script to be read by a speaker to produce a speech corpus for concatenative text-to-speech using a text database storing at least a dictionary of words and a pronunciation guide indicating a pronunciation of each of the words in the dictionary, the method comprising:

obtaining a list of phonemes to be uttered when the script is read by a speaker;

automatically selecting a first plurality of words from the dictionary based on the pronunciation guide such that the plurality of words, when uttered by the speaker, produces at least the phonemes in the list of phonemes;

obtaining at least one template defining structural properties of at least one grammar; and generating a cohesive script based, at least in part, on the at least one template and the first plurality of words, wherein the cohesive script comprises multiple sentences, and wherein at least two of the multiple sentences have conceptual coherence when considered together.

13. The at least one non-transitory machine-readable storage medium of claim 12, wherein all of the sentences in the coherent script have conceptual coherence.

14. A system for generating a script to be read by a speaker to produce a speech corpus for concatenative text-to-speech, the system comprising:

a text database storing at least a dictionary of words and a pronunciation guide indicating a pronunciation of each of the words in the dictionary;

at least one processor capable of accessing the text database, the at least one processor configured to implement:

an extracting unit to obtain a list of phonemes to be uttered when the script is read by a speaker;

a selecting unit to automatically select a first plurality of words from the dictionary based on the pronunciation guide such that the plurality of words, when uttered by the speaker, produces at least the phonemes in the list of phonemes; and an autonomous language generating unit to obtain at least one template defining structural properties of at least one grammar, and to automatically generate a cohesive script based, at least in part, on the at least one template and the first plurality of words, wherein the cohesive script comprises multiple sentences, and wherein at least two of the multiple sentences have conceptual coherence when considered together.

15. The system according to claim 14, wherein the list of phonemes includes a plurality of phoneme sequences each comprising a plurality of phonemes in a prescribed order, and wherein the first plurality of words, when uttered by the speaker, produces the plurality of phoneme sequences, and wherein the plurality of phoneme sequences together comprise a plurality of diphones, a plurality of triphones, a plurality of quadphones, a plurality of syllables defined in terms of phones, and/or a plurality of bisyllables.

16. The system according to claim 14, wherein the at least one template comprises a character template, a concept template, a location template, a story line template, and/or a script template that each includes structural properties that assist in forming the cohesive script.

17. The system according to claim 14, wherein the at least one processor is configured to implement a control unit that controls format mechanics of the cohesive script.

18. The system according to claim 17, wherein said format mechanics comprise a script size, a sentence structure, and/or a target sentence length of the cohesive script generated by said autonomous language generating unit.

19. The system according to claim 14, further comprising a recording unit capable of recording the speaker uttering the cohesive script to generate the speech corpus.

20. The system according to claim 14, wherein the text database comprises a vocabulary list, an unstructured vocabulary list, an inventory of occurrences of at least one phonemic unit, and/or an inventory of occurrences of at least one phonemic sequence.

21. The system of claim 14, wherein all of the sentences in the coherent script have conceptual coherence.

* * * * *